US008487711B2

(12) United States Patent
Ligander et al.

(10) Patent No.: US 8,487,711 B2
(45) Date of Patent: Jul. 16, 2013

(54) MICROSTRIP TO WAVEGUIDE TRANSITION ARRANGEMENT HAVING A TRANSITIONAL PART WITH A BORDER CONTACT SECTION

(75) Inventors: Per Ligander, Göteborg (SE); Marcus Hasselblad, Mölndal (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 208 days.

(21) Appl. No.: 12/743,910

(22) PCT Filed: Nov. 30, 2007

(86) PCT No.: PCT/EP2007/010406

§ 371 (c)(1),
(2), (4) Date: May 20, 2010

(87) PCT Pub. No.: WO2009/068071

PCT Pub. Date: Jun. 4, 2009

(65) Prior Publication Data

US 2010/0245000 A1 Sep. 30, 2010

(51) Int. Cl.
*H01P 5/107* (2006.01)

(52) U.S. Cl.
USPC ..... 333/26; 333/34

(58) Field of Classification Search
USPC ..... 333/26, 34
See application file for complete search history.

(56) References Cited

U.S. PATENT DOCUMENTS

| | | | | |
|---|---|---|---|---|
| 4,716,386 | A * | 12/1987 | Lait | 333/26 |
| 5,528,074 | A * | 6/1996 | Goto et al. | 257/664 |
| 7,019,600 | B2 * | 3/2006 | Shono | 333/26 |
| 2003/0197572 | A1 * | 10/2003 | Ammar | 333/26 |
| 2006/0145777 | A1 * | 7/2006 | Mueller | 333/26 |

* cited by examiner

*Primary Examiner* — Benny Lee

(57) ABSTRACT

The present invention relates to a transmission line to waveguide transition arrangement comprising a dielectric carrier material arrangement having a first main side and a second main side, the arrangement comprising a transition portion with an opening, having at least one edge and an electrically conducting border which follows the opening and is electrically connected to a ground metalization on the second main side. A transmission line conductor extends in the dielectric carrier material arrangement towards the border. The arrangement further comprises a transitional part with a border contact section having an outer circumference that essentially follows the border's shape except for a gap dividing the border contact section. The transitional part further comprises a conductor contact section which protrudes from the border contact section through the gap, contacting the end of the transmission line conductor and extending into the opening.

14 Claims, 6 Drawing Sheets

MICROSTRIP TO WAVEGUIDE TRANSITION ARRANGEMENT HAVING A TRANSITIONAL PART WITH A BORDER CONTACT SECTION

TECHNICAL FIELD

The present invention relates to a microstrip to waveguide transition arrangement comprising a dielectric carrier material arrangement having a first main side and a second main side, the arrangement comprising a transition portion which in turn comprises an opening, having at least one edge, and an electrically conducting border, which border follows the opening and is electrically connected to a ground metalization on the second main side, where a transmission line conductor extends in the dielectric carrier material arrangement towards the border.

BACKGROUND

When designing microwave circuits, microstrip transmission lines are commonly used. A microstrip transmission line comprises a metal ground plane and a conductor, where a dielectric carrier material is positioned between the metal ground plane and the conductor. This configuration is economical and relatively easy to design.

Another type of transmission line is a stripline conductor. Here, a conductor is sandwiched between two dielectric carrier materials, where ground planes are placed on the sides of the dielectric carrier materials that face away from the conductor.

Yet another type of transmission line is a co-planar conductor, where a conductor is placed on a dielectric carrier material and ground planes are placed on the same side of the dielectric carrier material as the conductor, surrounding it, with a small gap between the ground plane and the conductor.

However, due to losses in the dielectric carrier material, it is sometimes not possible to use any of the transmission lines above. When there for example is a filter in the layout, the filter may have to be realized in waveguide technology. Waveguides are normally filled with air or other low-loss materials.

When there is a filter in a microwave circuit microstrip layout, the filter may thus be realized by means of a waveguide filter in order to lower the losses. In that case, there has to be corresponding microstrip to waveguide transitions at the ends of the filter. Such a waveguide is preferably surface-mounted, enabling it to be mounted to the dielectric carrier material.

Such a surface-mounted waveguide is normally made having three walls and one open side. Metalization is then provided on the side of the dielectric carrier material facing the waveguide, where the metalization serves as the remaining wall of the waveguide, thus closing the waveguide structure when the waveguide is fitted to the dielectric carrier material.

Another application for surface-mounted waveguides is when there has to be a microstrip to waveguide transition in the form of a bend, allowing a waveguide to be mounted to the dielectric carrier material in such a way that the waveguide extends essentially perpendicular to the main surfaces of the dielectric carrier material.

It is also conceivable that a waveguide filter is realized having a separate fourth closing wall made as a metalization on a dielectric carrier material, where such a design is found cost-effective.

It is of course also common that it is desired to have a transition from a transmission line to a general waveguide interface.

A special case regarding surface-mountable waveguides is disclosed in the paper "Surface-mountable metalized plastic waveguide filter suitable for high volume production" by Thomas J Müller, Wilfried Grabherr, and Bernd Adelseck, 33$^{rd}$ European Microwave Conference, Munich 2003. Here, a surface-mountable waveguide is arranged to be mounted on a so-called footprint on a circuit board. A microstrip conductor to waveguide transition is disclosed, where the end of the microstrip conductor acts as a probe for feeding the waveguide's opening. The microstrip conductor is in contact with the waveguide via a stepped ridge, which matches the impedance in the transition. Furthermore, the transition region is bordered by via holes.

There is, however, a problem with the design according to the paper, as well as with general transitions from a transmission line to a waveguide interface, since a microstrip probe is carried by the circuit board, causing losses, and since there is a need of via holes, defining an electric wall through the circuit board.

There is thus a demand for a waveguide arrangement comprising a transmission line to waveguide transition that provides lower losses and a less expensive and simpler design.

SUMMARY OF THE INVENTION

The object of the present invention is to provide a waveguide arrangement comprising a transmission line to waveguide transition which provides lower losses and a less expensive and simpler design.

This problem is solved by means of a waveguide arrangement as mentioned initially. The arrangement further comprises a transitional part which in turn comprises a border contact section having an outer circumference that essentially follows the shape of the border except for a gap which divides the border contact section where it faces the end of the transmission line conductor, where the transitional part further comprises a conductor contact section which protrudes from the border contact section through the gap, in such a way that the conductor contact section contacts the end of the transmission line conductor and extends into the opening, from the transmission line conductor towards the border contact section.

According to a preferred embodiment, the ground metalization on the second main side is arranged for contacting a waveguide part which is mounted to the transition portion, where the ground metalization on the second main side is arranged to receive a waveguide flange.

According to another preferred embodiment, the dielectric carrier material consists of one dielectric layer, where the transmission line is a microstrip conductor or a co-planar conductor.

According to another preferred embodiment, the dielectric carrier material comprises at least two dielectric carrier layers, where the transmission line is a stripline conductor.

According to another preferred embodiment, the transitional part has an open structure facing away from the opening when the transitional part is mounted to the dielectric carrier material arrangement, where the open structure may be covered by a lid.

A number of advantages are provided by the present invention. For example:

- there is no need for a probe;
- a microstrip to waveguide transformer and a wave-guide bend are combined into one item, being constituted by the transitional part;
- there is no dielectric material in the wave-guide opening, which reduces losses;

very little area on the dielectric material arrangement is occupied by the transitional part; and enhanced soldering alignment is achieved since the transitional part may align to the border pattern.

BRIEF DESCRIPTION OF THE DRAWINGS

The present invention will now be described more in detail with reference to the appended drawings, where.

DETAILED DESCRIPTION OF THE INVENTION

Figure 1:
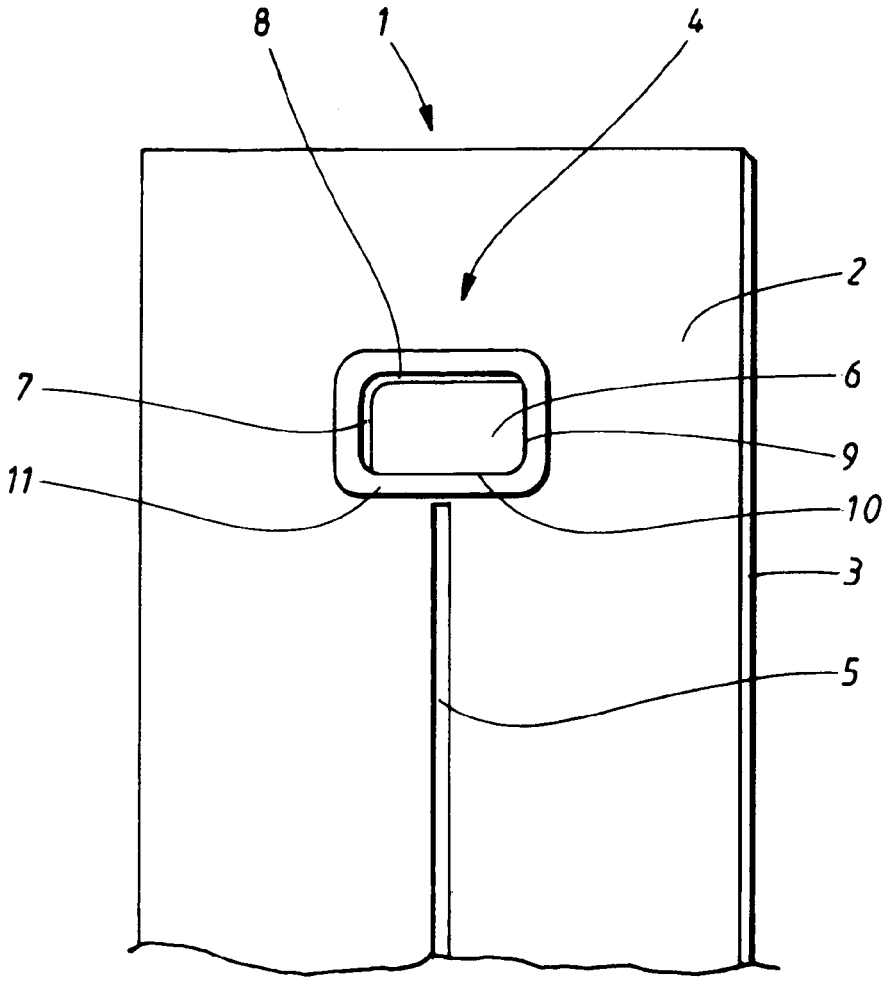
FIG. 1 shows a top perspective view of a dielectric carrier arranged for the present invention.

In FIG. 1, showing a first embodiment example of the present invention, a dielectric carrier material 1 (also shown in FIG. 5) is shown, having a first main side 2 (also shown in FIG. 5) and a second main side 3 (also shown in FIG. 5), originally having a metallic copper cladding on both sides. The copper on the second main side 3 is used as a ground plane, and the copper on the first main side 2 is etched away to such an extent that desired copper patterns are formed on the first main side 2. These copper patterns may for example form a microwave circuit layout, e.g. microstrip transmission line conductors and footprints for components which are intended to be soldered to the dielectric carrier (not shown).

A transition portion 4 is formed on the first main side 2 of the dielectric carrier 1, being intended for use as a transition from a microstrip transmission line conductor 5 extending on the first main side 2 such that a waveguide port, lying in the dielectric carrier's plane and facing 90° away from the longitudinal extension of the microstrip transmission line conductor 5 (also shown in FIG. 4*d*), is formed. The transition portion 4 comprises an opening 6 which has an essentially rectangular shape, having a first edge 7, a second edge 8, a third edge 9 and a fourth edge 10, where the corners are slightly rounded due to manufacturing methods, and the edges 7, 8, 9, 10 are facing inwards the opening 6. The fourth side 10 faces the incoming microstrip conductor 5.

The transition portion 4 comprises a border 11 of copper, having a certain width, which border 11 follows the opening's edges 7, 8, 9, 10. The border 11 is electrically connected to the ground plane on the second main side 3 via copper plating on the opening's edges 7, 8, 9, 10. In this embodiment, the microstrip conductor 5 extends towards the border 11, but stops a short distance before the border 11, not making electric contact.

Figure 2A:
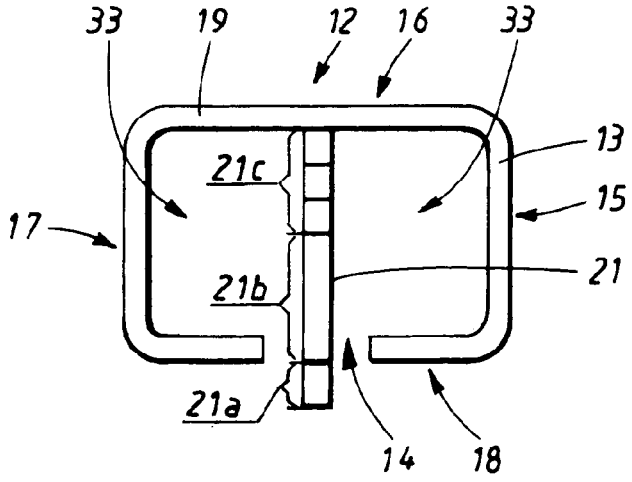
FIG. 2*a* shows a top view of the transitional part according to the present invention.
Figure 2B:
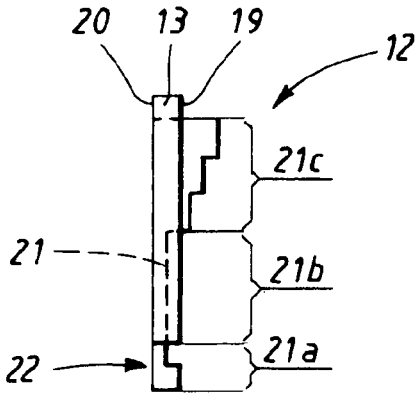
FIG. 2*b* shows a side view of the transitional part according to the present invention.

According to the present invention, with reference to FIG. 2*a* and FIG. 2*b*, in order to achieve a microstrip conductor to waveguide transition, the waveguide transition arrangement comprises a transitional part 12 (also shown in FIG. 4*d*) which is adapted to be mounted to the border 11 (FIG. 1), having a border contact section 13 that essentially follows the shape of the border 11 except for a gap 14 (FIG. 2*a*), dividing the border contact section 13 where the border contact section 13 faces the end of the microstrip conductor 5 when mounted to the border 11. The border contact section 13 thus comprises a first wall 15, a second wall 16, a third wall 17 and a fourth wall 18, as shown in FIG. 2*a*, where the fourth wall 18 of the border contact section lies against the fourth edge 10 of the opening 6 when mounted to the border 11, and the second wall 16 is opposite the fourth wall 18, where the gap 14 is situated on the middle of the fourth wall 18.

The walls 15, 16, 17, 18 define a first continuous surface 19, arranged to face the border, and a second continuous surface 20 (FIG. 2*b*), arranged to face away from the border 11, when the transitional part 12 is mounted to the border 11.

The transitional part 12 further comprises a conductor contact section 21 which protrudes from the middle of the second wall 16, through the gap 14, in such a way that it contacts the end of the microstrip conductor 5 when the transitional part 12 is mounted to the border 11.

The conductor contact section 21 has a height perpendicular to the main extension of the second wall 16 and a width that corresponds to the width of the microstrip conductor 5.

The following relates to the case where the transitional part 12 is mounted to the border 11. The conductor contact section 21 (FIG. 2*b*) has a contact part 21*a* that is arranged to be in the same level as the microstrip conductor 5, the level being essentially the same as the level of the first surface 19. Then follows a raised part 21*b*, being raised relative to the dielectric carrier 1 such that contact with the dielectric carrier 1, and thus the border 11, is avoided. Then follows a stepped part 21*c*, comprising steps extending past the level of the first surface 19, into the opening 6.

The side 22 of the conductor contact section 21 opposite the one that contacts the microstrip conductor lies in the same level as the second surface 20.

The use of such a stepped structure in a microstrip to waveguide transition is well-known in the art, and will not be discussed more in detail here.

Figure 3:
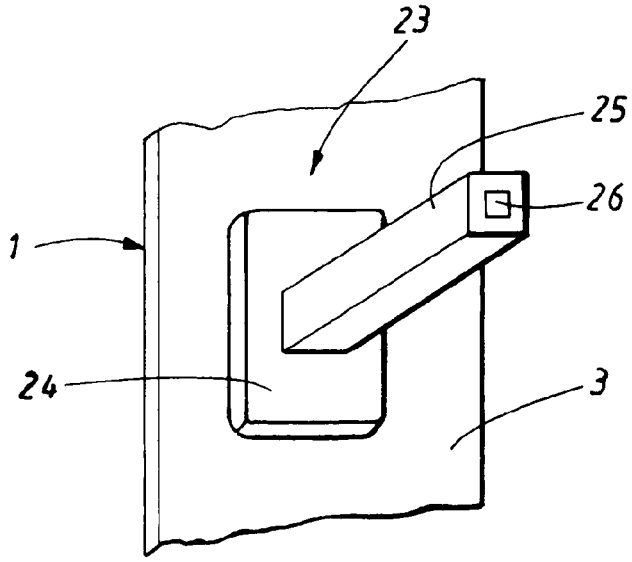
FIG. 3 shows a first type of a waveguide part used with the present invention.

An example of a first type of waveguide part 23 arranged to be mounted to the transition arrangement according to the present invention is shown in FIG. 3. Such a waveguide part is constituted by a waveguide flange 24 that is arranged to be mounted to the second main surface 3 of the dielectric carrier 1, and a waveguide tube 25 which may extend away from the dielectric carrier 1, the waveguide tube 25 being shown cut open for explanatory reasons. The waveguide part 23 is hollow with a cross-sectional aperture 26, the cross-sectional aperture 26 having a certain dimension that depends on the frequency for which the waveguide part 23 is intended to be used. The flange 24 is shown mounted to the opening 6 (not shown in FIG. 3) in the dielectric material 1, the opening 6 forming a waveguide contact interface, or waveguide port, on the second side 3 of the dielectric carrier 1. The opening 6 has a dimension that corresponds to the waveguide's cross-sectional aperture 26. The transitional part 12 is mounted to the border as discussed above (not shown).

Figure 4A:
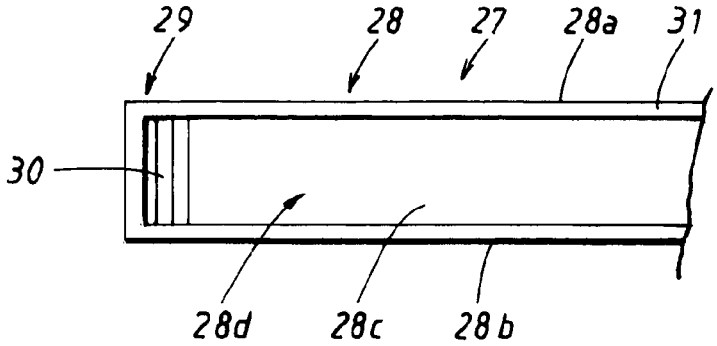
FIG. 4*a* shows a bottom view of a second type of a waveguide part used with the present invention.
Figure 4B:
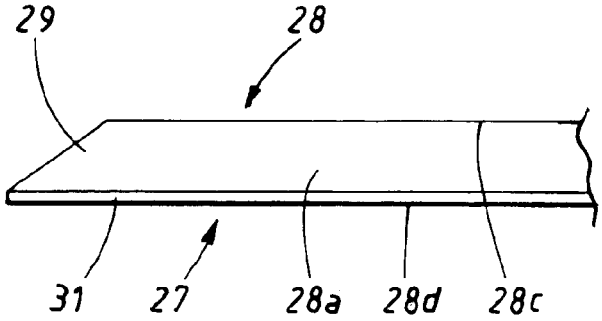
FIG. 4*b* shows a side view of a second type of a waveguide part used with the present invention.
Figure 4C:
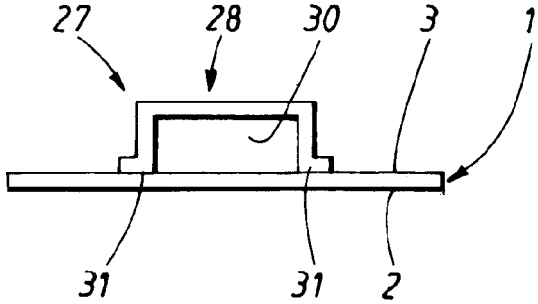
FIG. 4*c* shows an end view of a second type of a waveguide part used with the present invention, mounted to a dielectric carrier material.
Figure 4D:
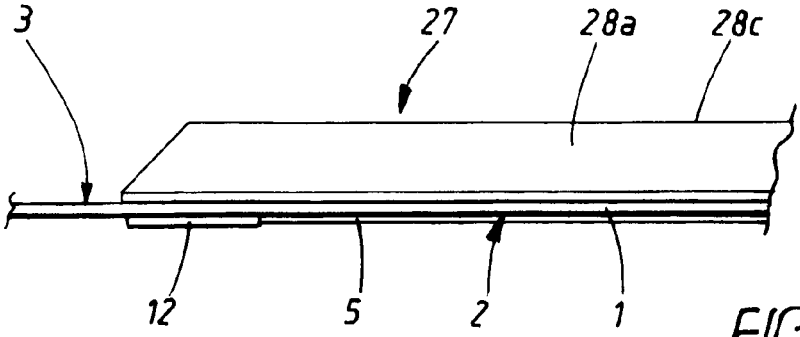
FIG. 4*d* shows a side view of a second type of a waveguide part used with the present invention, mounted to a dielectric carrier material.

A second type of waveguide part arranged to be mounted to the transition arrangement according to the present invention is shown in FIG. 4*a*-4*d*. Here, a surface-mounted waveguide part 27 (FIGS. 4*a*, 4*b*, 4*d*) is used instead, being mounted to the second main 3 side of the dielectric carrier 2, as shown in FIGS. 4*b*, 4*d*. The surface-mounted waveguide part 27 is constituted by an open waveguide tube 28 (FIGS. 4*a*-4*c*) having only three closed walls 28*a* (FIGS. 4*a*, 4*b*, 4*d*), 28*b* (FIG. 4*a*), 28*c* (FIGS. 4*a*, 4*b*, 4*d*), leaving one side 28*d* (FIG. 4*b*) open. The tube 28 has an interface portion 29 (FIG. 4*a*, 4*b*) which is intended to be mounted to a waveguide port, functioning as a flange. The waveguide tube 28 performs a 90° turn directly after the interface portion 29 such that it is arranged to be mounted to the second main surface of the dielectric carrier, the interface portion 29 being equipped with a stepped portion in a well known manner. The open side 28*d* is intended to be closed when the second type of waveguide part 27 is mounted to the second main surface 3 of the dielectric carrier 1. The extension of the waveguide tube 28 is limited by a broken line, since its further functions are of no interest for the present invention.

When mounted, the second waveguide part's waveguide tube 28 is hollow with a cross-sectional aperture 30 (FIG. 4*a*, 4*c*), the cross-sectional aperture 30 having certain dimensions that depend on the frequency for which the waveguide part is intended to be used. The interface portion 29 is mounted to the opening 6 (not shown in FIG. 4*d*) in the dielectric material 1 (FIGS. 4*c*, 4*d*), the opening 6 forming a waveguide contact interface, or waveguide port, on the second side 3 of the dielectric carrier 1. The opening 6 has a dimension that corresponds to the waveguide's cross-sectional aperture. The mounting is performed by means of mounting aims 31 (FIGS. 4*a*-4*c*) running along the open waveguide tube.

Such a surface-mounted waveguide part is previously known, its details will not be discussed further here.

The present invention is not limited to the embodiment described above, but may vary freely within the scope of the appended claims.

Figure 5:
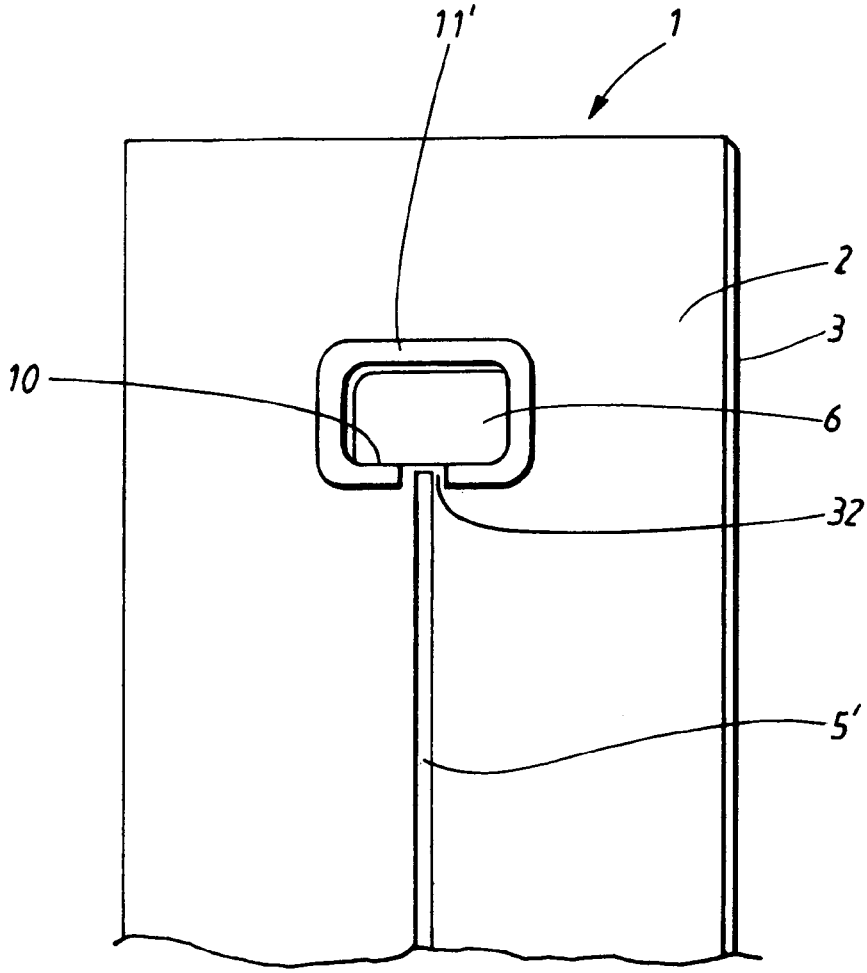
FIG. 5 shows a top perspective view of an alternative for a dielectric carrier arranged for the present invention.

For example, with reference to FIG. 5, an alternative border 11 may be equipped with a gap 32 that corresponds with the one in the transitional part's border contact section 13 (FIGS. 2*a*, 2*b*), allowing an alternative microstrip conductor 5' to pass the border and end just before the fourth edge 10 of the opening 6. In this way, the transitional part's conductor contact section may have an alternative shape, not having to extend over the border, but can be made shorter.

Figure 6:
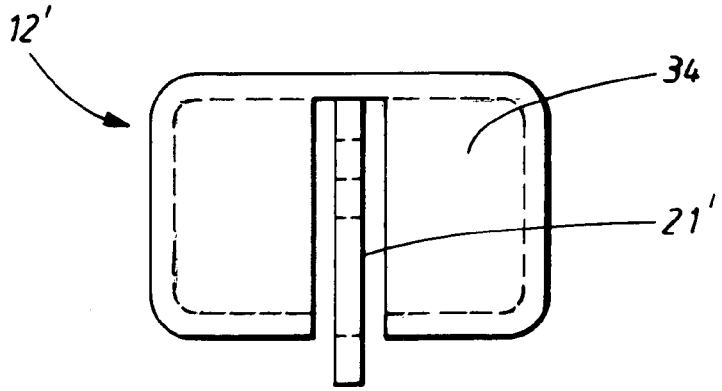
FIG. 6 shows a top view of a first alternative for the transitional part according to the present invention.

Furthermore, with reference to FIG. 2*a*, inside the inner boundaries of the second surface 20, there is an open structure 33 facing away from the opening in the dielectric carrier 1 when the transitional part 12 is mounted to the dielectric carrier material 1. Optionally, with reference to FIG. 6, showing a top view of another alternative design of the transitional part 12', this open structure may be covered by means of an electrically conducting lid 34 which covers the open structure, without contacting the conductor contact section 21', thus reducing the amount of microwave radiation escaping through the open structure.

Figure 7:
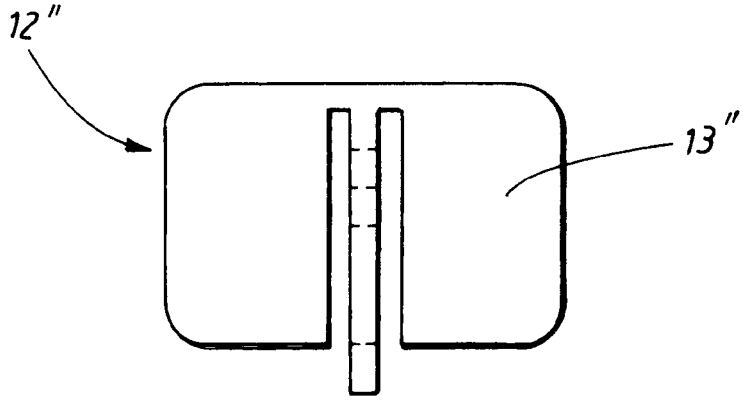
FIG. 7 shows a top view of a second alternative for the transitional part according to the present invention.

With reference to FIG. 7, showing a top view of another alternative design of the transitional part 12" the border contact section 13" is increased in size, having no open structure, not needing any lid.

All mountings above are preferably performed by means of soldering, but of course other alternatives are possible, for example gluing with electrically conducting glue.

The transitional part may be made in one piece or by several pieces. In the latter case, all pieces should be in electrical contact.

The opening which essentially corresponds to the waveguide's cross-sectional aperture is of course adapted to the shape of the waveguide used. The opening is thus circular if a circular waveguide is used. Manufacturing methods also give rise to different shapes of the opening and the used waveguide's cross-sectional aperture, the smaller the opening is, the larger radius the rounded corners will have. All related parts, such as the transitional part and the border are shaped correspondingly.

The waveguide parts disclosed, including the transitional part, which for example may be made in metal or metallized plastics, are only two examples of a variety of waveguide parts that may be used with the present invention, which in itself does not include any special waveguide part, but only is arranged to interact with a waveguide part.

The exact measures of the parts described, for example the number of step of the stepped part and the steps' measures depends on the frequency used and which characteristics the design shall have. These details are not a part of the present invention, and can be derived for each specific design by the skilled person. The essence of the present invention is to use a transitional part for a transmission line to waveguide transition, the transitional part enabling the use of an opening in the dielectric carrier, thus dispensing with via holes and the presence of a lossy dielectric material at the waveguide transition.

Figure 8A:
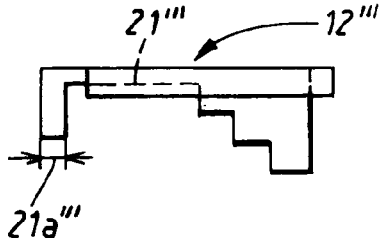
FIG. 8*a* shows a side view of a third alternative for the transitional part according to the present invention, adapted for a stripline arrangement.
Figure 8B:
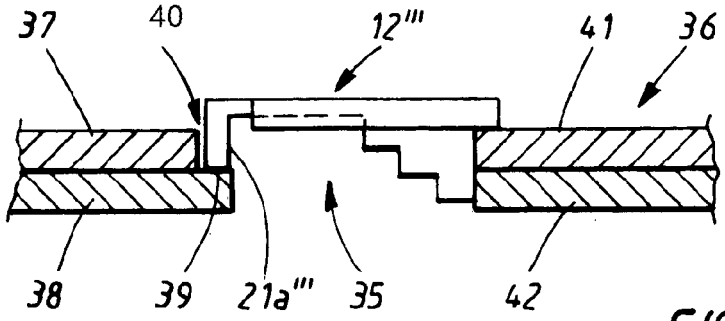
FIG. 8*b* shows a side view of the third alternative for the transitional part according to the present invention mounted to a stripline arrangement.

The transmission line may be of any suitable kind, such as microstrip, stripline or co-planar. With reference to FIG. 8*a*, showing an alternative design of the transitional part 12'"adapted to be used for a stripline to waveguide, the transitional part's conductor contact section 21'" has a contact part 21*a*'" that is modified for stripline use. With reference to FIG. 8*b*, a section across an opening 35 in a stripline arrangement 36 to which the transitional part 12'" is mounted is shown. The stripline arrangement comprises a first dielectric carrier material 37 and a second dielectric carrier material 38 and a conductor 39 which is sandwiched between the dielectric carrier materials 37, 38.

Figure 8C:
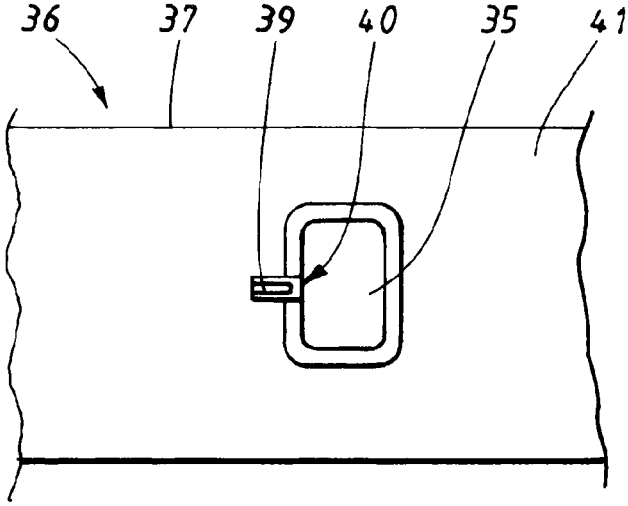
FIG. 8*c* shows a top view of a stripline arrangement according to the third alternative for the transitional part according to the present invention.

The transitional part's conductor contact section 21'" is arranged to extend past the first dielectric carrier material 37, such that it contacts the conductor 39 (FIG. 8*c*). There is thus an access opening 40 (FIG. 8*c*) through the first dielectric carrier material 37, allowing the contact part 21*a*'" to reach the conductor 39. A top view of the stripline arrangement 36 without the transitional part 12'" is shown in FIG. 8*c*.

As shown in FIGS. 8*a*-8*c*, the stripline arrangement also comprises copper ground planes 41 (FIG. 8*c*), 42 on the sides of the dielectric carrier materials 37 (FIG. 8*c*), 38 which face away from the conductor 39. The opening 35 (FIG. 8*c*) is copper plated in such a way that the ground planes are in electrical contact.

For all embodiments, any suitable metal or alloy may be used for the conducting parts, copper has been mentioned, and examples of other suitable metals are silver and gold.

All conducting structures on the dielectric carrier materials are suitably made by means of etching, although other processes such as screen-printing also are conceivable.

The dielectric carrier material 1 may comprise several dielectric materials, thus constituting a dielectric material arrangement. In cases of multilayer arrangements for the dielectric carrier, such as a stripline arrangement which comprises two dielectric carrier materials, such a dielectric carrier material arrangement still comprises a first main side and a second main side, where the main sides are those that are not adjacent to any other side, i.e. those which face away from the dielectric carrier material arrangement. For example, in the stripline case above, the sides carrying the ground planes are the first and second mains ides.

Where the conductor is embedded, such as in the stripline case, the waveguide transition part is adapted for this as described above.

The copper plating on the opening's edges 7, 8, 9, 10 may be constituted by any appropriate electrically conducting element.

Even though it may make the design less simple, it is of course possible to electrically connect the border 11 to the ground plane on the second main side 3 by means of any other suitable means than plating, for example by means of vias.

Figure 9:
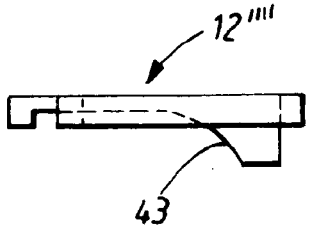
FIG. 9 shows a side view of an alternative transitional part according to the present invention.

Furthermore, the stepped structure may for an alternative transitional part 12"" be replaced with a continuous structure 43 having an arcuate shape, as shown in FIG. 9.

The conducting parts, in particular the ground plane and the border, may have any suitable shape. The border has to follow the opening and the ground plane may be any suitable ground metalization. The border is electrically connected to the ground metalization on the second main side via an electrically conducting plating on the edge.

The invention claimed is:

1. A transmission line to waveguide transition arrangement comprising a dielectric carrier material arrangement having a first main side and a second main side, the arrangement comprising a transition portion which in turn comprises an opening having at least one edge, and an electrically conducting border, wherein the border follows the opening and is electrically connected to a ground metalization on the second main side, where a transmission line conductor extends in the dielectric carrier material arrangement towards the border, wherein the arrangement further comprises a transitional part, positioned in the opening, which the transitional part in turn comprises a border contact section having an outer circumference that essentially follows the shape of the border except for a gap in the border contact section which divides the border contact section where the border contact section faces the end of the transmission line conductor, where the transitional part further comprises a conductor contact section which protrudes from the border contact section through the gap in such a way that the conductor contact section contacts the end of the transmission line conductor and extends into the opening, from the transmission line conductor towards the border contact section.

2. A transmission line to waveguide transition arrangement according to claim 1, wherein the ground metalization on the second main side is arranged for contacting a waveguide part which is mounted to the transition portion.

3. A transmission line to waveguide transition arrangement according to claim 2, wherein the ground metallization on the second main side is arranged to receive a waveguide flange.

4. A transmission line to waveguide transition arrangement according to claim 1, wherein the dielectric carrier material comprises one dielectric layer.

5. A transmission line to waveguide transition arrangement according to claim 4, wherein the transmission line conductor is a microstrip conductor.

6. A transmission line to waveguide transition arrangement according to claim 1, wherein the border is electrically connected to the ground metallization on the second main side by means of an electrically conducting plating on edges of the opening.

7. A transmission line to waveguide transition arrangement according to claim 1, wherein the dielectric carrier material comprises at least two dielectric carrier layers.

8. A transmission line to waveguide transition arrangement according to claim 7, wherein the transmission line conductor is a stripline conductor.

9. A transmission line to waveguide transition arrangement according to claim 1, wherein that the transmission line conductor extends towards the border without contacting the border.

10. A transmission line to waveguide transition arrangement according to claim 1, wherein the border includes a gap through which the transmission line conductor extends.

11. A transmission line to waveguide transition arrangement according to claim 1, wherein the transitional part has an open structure facing away from the opening when the transitional part is mounted to the dielectric carrier material arrangement.

12. A transmission line to waveguide transition arrangement according to claim 11, wherein the open structure is covered by a lid.

13. A transmission line to waveguide transition arrangement according to claim 1, wherein the transitional part is made of an electrically conducting metal.

14. A transmission line to waveguide transition arrangement according to claim 1, wherein the transitional part is made of an electrically insulating material covered with a layer of electrically conducting material.

* * * * *